United States Patent [19]

Fienberg

[11] Patent Number: 4,943,090

[45] Date of Patent: Jul. 24, 1990

[54] LOTTERY-TYPE GAMING APPARATUS

[75] Inventor: Debra Fienberg, Chicago, Ill.

[73] Assignee: Douglas Press, Inc., Bellwood, Ill.

[21] Appl. No.: 335,564

[22] Filed: Apr. 10, 1989

[51] Int. Cl.[5] ..... B42D 15/00; A63B 71/00

[52] U.S. Cl. ..... 273/139; 283/901

[58] Field of Search ..... 273/138 R, 139; 283/72, 283/73, 94, 901, 903

[56] References Cited

U.S. PATENT DOCUMENTS

| | | | |
|---|---|---|---|
| 3,900,219 | 8/1975 | D'Amato et al. | 273/139 |
| 4,373,726 | 2/1983 | Churchill et al. | 273/139 |
| 4,667,553 | 6/1987 | Roberts et al. | 283/903 |
| 4,740,016 | 4/1988 | Konecny et al. | 283/903 |

OTHER PUBLICATIONS

Product brochure, "Classic Criss Cross" break open games Nov. 1988.

Product brochure, "Magnificent Cris Cross", Win--Code and Pay-Code games, 1989.

Product brochure, "Oink" break open games, Win--Code and Pay-Code Games, 1989.

Product brochure, "Diamond Heist", Win Guard break open games, 1989.

Product brochure, "Bonus Diamonds" Win-Code and Pay Code games, 1989.

"Winners Choice Sweepstakes;" American Motors Corporation; 1978.

Product brochure, "criss-cross" breakopen games; pp. 1-6; 1986.

Product brochure, "criss-cross" breakopen game; 2 pages.

*Primary Examiner*—George J. Marlo

*Assistant Examiner*—W. Pierce

*Attorney, Agent, or Firm*—Dressler,Goldsmith,Shore,Sutker & Milnamow, Ltd.

[57] ABSTRACT

A lottery-type gaming system is disclosed which includes a plurality of playing cards, one or more of which are purchased by players for playing the game. Each of the playing cards displays initially-concealed groups of game symbols, wherein predetermined ones of the groups correspond to predetermined award values. Certain ones of the playing cards having winning groups of game symbols include multiple winning groups of the symbols. These multiple winner playing cards further display a code designation corresponding to the total award value of all of the winning groups of game symbols. The present gaming system includes an associated code key, such as for use by the game operator, for quickly and accurately determining the total award value for the multiple winner playing cards.

6 Claims, 2 Drawing Sheets

FIG. 3
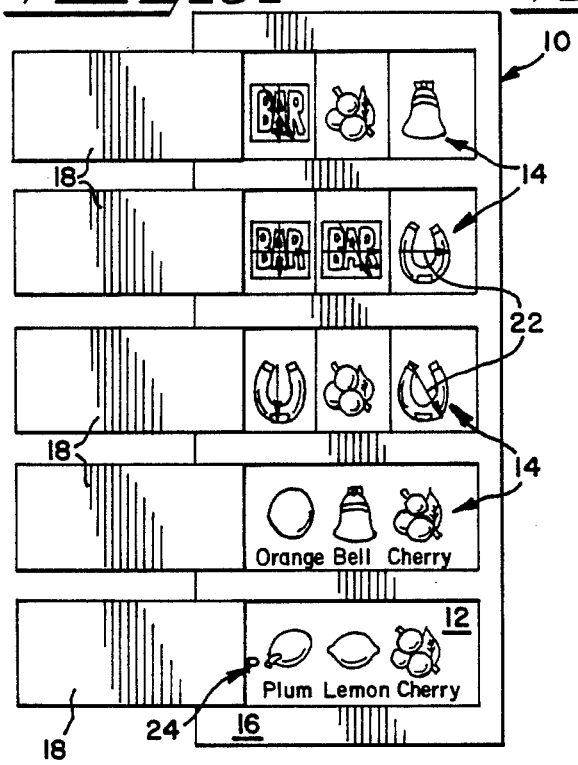
FIG. 4
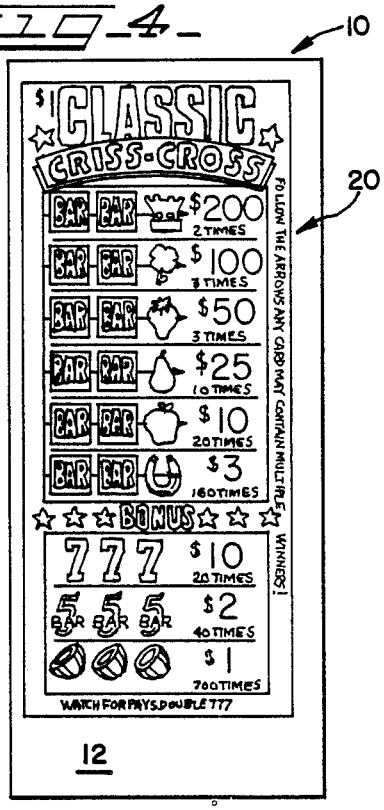
FIG. 5
26
$1 CLASSIC CRISS CROSS MULTIPLE WINNERS PAYOUTS
Game #205
To determine the amount of the payout on a multiple winner card, find the letter printed just to the left of the symbols in the last tab and match it to the pay codes, shown below.
$1
24
| | | | |
|---|---|---|---|
| A | $250.00 | L | $6.00 |
| B | $157.00 | M | $5.00 |
| C | $103.00 | N | $12.00 |
| D | $53.00 | P | $9.00 |
| E | $35.00 | Q | $6.00 |
| F | $21.00 | R | $21.00 |
| G | $16.00 | S | $20.00 |
| H | $13.00 | T | $12.00 |
| J | $25.00 | U | $11.00 |
| K | $15.00 | | |

LOTTERY-TYPE GAMING APPARATUS

TECHNICAL FIELD

The present invention relates generally to lottery-type games, and more particularly to a chance-based gaming system including a plurality of potentially winning playing cards having concealed groups of game symbols, and an associated code key for determining the total award value for those playing cards having multiple groups of winning game symbols.

BACKGROUND OF THE INVENTION

The popularity of lottery-type games of chance extends throughout the world. In their most popular forms, games of this type can ordinarily be played for a relatively low initial "investment", with the typical game affording the player the opportunity to win prizes that can be many times the initial cost of play. Relatively smaller prizes are also typically awarded, thus providing players the chance to win many different prizes.

Games of this nature are not only popular for the entertainment value they afford to players, but further, typically provide a source of revenue for the operator of the game. Game operators may be municipal or state governments, charitable groups, or private organizations. For government and charitable organizations, such games desirably augment other sources of revenue in a manner which is popular with the game players. For a private organization, such as a tavern or nightclub operator, the entertainment provided to patrons who play the game can be just as valuable as the revenue the game generates.

As will be appreciated, the entertainment and fun which these types of games of chance provide can be enhanced by affording a player the opportunity to win more than one prize from a single ticket, playing card, or like playing piece. Thus, some games are arranged so that a single playing piece may have multiple winning combinations of numbers, letters, or other game symbols. Ordinarily, each winning combination of symbols corresponds to a predetermined award value or prize, with a ticket having multiple winning combinations thus being worth the total of the combined award value of all of the winning combinations.

Bearing in mind that games of the present type are frequently played in taverns or nightclubs, at charitable "casino nights", and the like, it is not unusual that the operator of the game may have a large number of players, and may be responsible for other activities at the establishment. In this context, correct determination of the total award value for game pieces having multiple winning combinations can be distracting and time-consuming. Obviously, proper determination of the total award value is important for both the game player and the operator.

Accordingly, the present gaming system has been particularly configured to not only provide players with the entertainment of potential multiple winning playing cards, but additionally provides an arrangement whereby the operator of the game can quickly and accurately determine the total award value of those game cards having multiple winning combinations.

SUMMARY OF THE INVENTION

The present lottery-type gaming system includes a plurality of playing cards, each of which can be purchased by game players for a predetermined price. Each playing card has groups of game symbols, which are initially concealed. The gaming system is arranged such that some of the playing cards have multiple winning groups of game symbols displayed thereon, with such multiple winner cards further displaying code designations corresponding to the total award value of the multiple winning groups. The present system further includes a code key which the game operator uses to conveniently and accurately determine the total of the award values of one of the multiple winner playing cards.

In the illustrated embodiment, each of the playing cards of the present system has a plurality of groups of game symbols displayed thereon. The symbols may be thematic in nature, and in the illustrated embodiment, generally correspond to the types of symbols found on slot machines.

In the illustrated form, each of the playing cards comprises a lamination of upper and lower plies of material, with the game symbols displayed on the lower ply. The upper ply overlies the lower ply, and comprises selectively removable means for initially concealing the groups of game symbols displayed on the lower ply of each game card. In the illustrated form, the upper ply of each card includes frangible means, such as suitable perforations or the like, whereby flap-like portions of the upper ply can be lifted by a player after purchase to reveal the groups of game symbols beneath each flap. Thus, prior to purchase, the groups of game symbols are concealed, adding to the entertainment value of the game, and facilitating random selection of the cards.

At least some of the playing cards are in the form of "winning" playing cards, by virtue of them having at least one of the groups of gaming symbols displayed thereon corresponding to at least one of a plurality of predetermined winning groups of the symbols. In accordance with a predetermined listing, each of the winning groups corresponds to a predetermined award value, shown in dollar amounts in the illustrated embodiment. In the preferred form, each of the playing cards has displayed thereon a listing of the various winning groups of game symbols, so that a player can easily determine the award value of any winning group displayed on the player's card.

While some of the winning playing cards have only a single winning group of game symbols, at least some of the winning playing cards are in the form of "multiple winner" playing cards, by virtue of them having displayed thereon multiple ones of the predetermined winning groups of symbols. Notably, such multiple winner playing cards each have one of a plurality of different multiple winner code designations displayed thereon, with the code designations also concealed by the flap-like portions of the upper ply prior to purchase.

Each of the multiple winner code designations corresponds to a predetermined total of the plural award values of the multiple winner playing card on which the code designation is displayed. In order to "translate" the code, the present system includes a separate multiple winner code key for the game operator. The code key has displayed thereon all of the plurality of different multiple winner code designations, and all of the predetermined totals of plural award values to which the code designations correspond. By this arrangement, the operator can quickly and accurately determine the total award value of one of the multiple winner playing cards.

In the illustrated form, each of the playing cards includes five horizontally arranged rows of the groups of game symbols for play of the card. However, the illustrated form is designated "Criss Cross", in that winning groups of the game symbols need not be horizontally arranged, but also can be arranged vertically or diagonally. To assist players in identifying the winning groups of symbols, the winning playing cards are preferably provided with winning indicia, illustrated in the form of arrows, operatively displayed in association with each of the winning groups of game symbols.

Other features and advantages of the present invention will become readily apparent from the accompanying drawings, the following detailed description, and the appended claims.

BRIEF DESCRIPTION OF THE DRAWINGS

FIG. 3 is a view similar to FIG. 2 further illustrating a playing card of the present system ready for play;

FIG. 4 is a plan view of the opposite side of one of the playing cards of the present system, wherein a listing of the various winning groups of game symbols is displayed; and FIG. 5 is a multiple winner code key for use by an operator of the present gaming system which lists various multiple winner code designations, and the corresponding totals of award values for the multiple winning groups.

DETAILED DESCRIPTION

Figure 2:
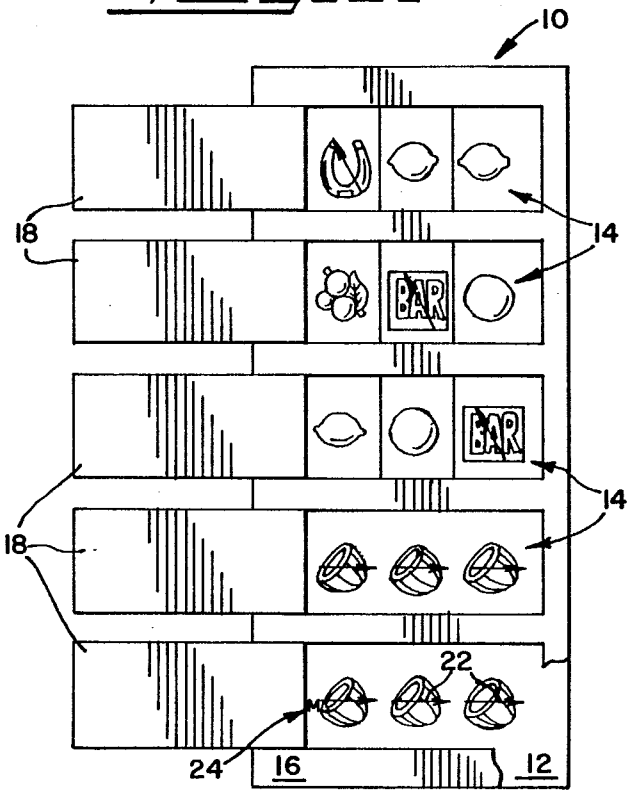
FIG. 2 is a playing card such as illustrated in FIG. 1, partially cutaway, wherein plural groups of game symbols have been revealed for game play.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 1:
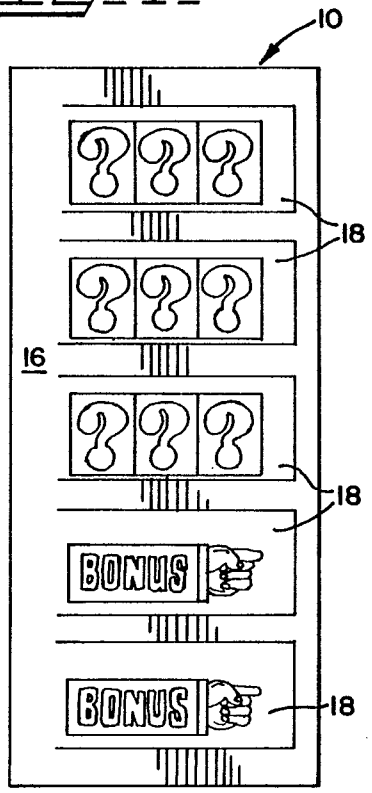
FIG. 1 is a top plan view of a playing card of the present gaming system in the form in which it is purchased by a player.

Referring first to FIGS. 1 and 2, therein are illustrated playing cards 10 which are representative and illustrative of the type of playing card which is provided by the gaming system of the present invention. It is contemplated that a single "set" of the present gaming system would include a large plurality of playing cards 10, such as on the order of several thousand, with each of the cards being purchased by players for a nominal sum, such as $ 0.50 or $ 1.00. Of the numerous cards, certain ones, unknown to the operator and players, are "winning" cards by virtue of them having displayed thereon initially-concealed groups of game symbols, wherein predetermined groups correspond to predetermined award values. While the illustrated form shows the award values in dollar designations, it will be appreciated that a game embodying the present invention can be played for award values in the form of points for prizes, or the like.

As illustrated, each of the playing cards 10 is a lamination of upper and lower plies of material specifically, a lower ply 12 having displayed thereon groups 14 of game symbols, and an upper ply 16 overlying the lower ply. In the illustrated form, the upper ply 16 includes frangible means to thereby define a plurality of flap-like portions 18 which are respectively arranged in registry with the groups 14 of game symbols, and thereby act to conceal the game symbols prior to purchase of the playing card. For play, each of the flap-like portions 18 can be easily lifted after fracture of the associated frangible means, and bent to an out-of-the-way disposition so as to reveal the group 14 of game symbols disposed therebeneath. As will be appreciated, alternate means for concealing the game symbols can be employed while keeping with the principles of the present invention. For example, removable opaque coatings, as are known in the art, can be employed, wherein play of a card is effected by removing the coating such as by scratching or other abrasion. Additionally, groups of the game symbols can be provided on the inner surface of the upper ply 16, such as on the interior of the flap-like portions 18.

As will be evident from the illustrated embodiment, the game symbols on the playing cards 10 are generally in the nature of those symbols found on slot machines. In keeping with this theme, certain predetermined groups of the game symbols correspond to predetermined award values. In the preferred form, each of the playing cards 10 has displayed thereon, on the reverse surface of lower ply 12 opposite the game symbols, a listing 20 of the various ones of the plurality of predetermined winning groups, as illustrated in FIG. 4. By this preferred arrangement, a player can readily determine the award value of any predetermined winning group of the game symbols displayed on the player's card.

In order to further assist a game player with determining the presence of a winning group of game symbols on the player's card, winning indicia 22 are preferably operatively displayed in association with each of the winning groups of game symbols. As illustrated in FIGS. 2 and 3, winning indicia 22 may be in the form of sequentially arranged arrows extending through the three game symbols of the one or more winning groups on a winning player card. As shown in FIG. 3, the illustrated embodiment of the present gaming system is arranged so that winning groups of game symbols can be arranged horizontally, vertically, or diagonally, thus adding to the entertainment value of the game.

Naturally, in accordance with the chance element of all lottery-type games, not all of the playing cards 10 of the present gaming system will display one or more winning groups of game symbols. For those having a single winning group of the symbols, such as indicated by the winning indicia 22, a player may easily refer to t he listing 20 on the back of the card to ascertain the award value of the winning group.

For those playing cards 10 having multiple winning groups of the game symbols, such as illustrated in FIGS. 2 and 3, the present system contemplates the display of multiple winner code designations 24, which are preferably alphabetic in nature, and are reserved for use only on those playing cards 10 having multiple ones of the winning groups of game symbols.

Each multiple winner playing card 10 includes one of a plurality of different code designations 24, with each designation corresponding to the predetermined total of the plural award values of the multiple winner card on which the code designation is displayed. These various totals are calculated in accordance with the predetermined individual award values for each of the winning groups, such as shown at listing 20 on each card.

As will be appreciated, part of the entertainment value for players of the present gaming system is derived from discovering and totaling the various award values of one of the multiple winner playing cards. Thus, a player would not ordinarily refer to the code designation 24, but rather would refer to the listing 20 of the various winning combinations of game symbols.

In contrast, the game operator must be able to quickly and accurately ascertain the total award value of a multiple winner playing card. This is preferably accomplished without the need to perform mental calculations, which invariably result in errors, either to the annoyance of the player or to the detriment of the operator.

Accordingly, in order to "translate" the multiple winner code designations 24, the present gaming system includes a multiple winner code key 26, as illustrated in FIG. 5, to assist the game operator in totaling and awarding the total of the predetermined award values of a multiple winner playing card. As illustrated in FIG. 5, the code key 26 has displayed thereon all of the plurality of different multiple winner code designations 24 for the various multiple winner playing cards in the total gaming system. Additionally, the code key displays all of the predetermined totals of the plural award values to which the code designations correspond. Thus, the game operator can conveniently and accurately determine the total award value for a multiple winner playing card. Inadvertent errors are thus avoided, enhancing enjoyment of the game by the players, and desirably contributing to the speed and accuracy with which the game is administered by the operator.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover all such modifications as fall within the scope of the claims.

What is claimed is:

1. A lottery-type gaming apparatus, comprising:

a plurality of playing cards, each of which can be purchased by game players for a predetermined price for each of said playing cards, each of said playing cards having plurality of groups of game symbols displayed thereon, with each of said playing cards including selectively removable means for initially concealing the groups of game symbols displayed thereon prior to purchase of a playing card by a player, said means for concealing said game symbols being removed by the player after purchase, at least some of said playing cards being in the form of winning playing cards by having at least one of said groups of gaming symbols displayed thereon corresponding to at least one of a plurality of predetermined winning groups of said game symbols, each of said predetermined winning groups corresponding to a predetermined award value awarded to the player, each of said playing cards having displayed thereon a listing of the various ones of the plurality of predetermined winning groups of said game symbols so that a player can determine the award value of any predetermined winning group of said game symbols displayed on the player's card, at least some of said winning playing cards being in the form of multiple winner playing cards by having displayed thereon multiple ones of said predetermined winning groups of said game symbols, said multiple winning playing cards each further including, in addition to said multiple predetermined winning groups, one of a plurality of different multiple winner code designations displayed thereon and concealed by said means for concealing prior to purchase but visible upon removal of said concealing means, each said multiple winner code designation corresponding to a predetermined total of the plural award values of the multiple winner playing card on which the code designation is displayed; and a multiple winner code key separate from each of said playing cards and having displayed thereon all of the plurality of different multiple winner code designations and all of the predetermined total of plural award values to which the code designations correspond, to thereby facilitate convenient determination of the total award values of one of said multiple winner playing cards.

2. A gaming apparatus in accordance with claim 1, including winning indicia means operatively displayed with each of the winning groups of game symbols of said winning playing cards to assist a player in identifying the winning groups.

3. The gaming apparatus in accordance with claim 1, wherein each of said playing cards comprising a lamination of upper and lower plies of material, said groups of game symbols being displayed on said lower one of said plies of material, said upper ply of material overlying said lower ply, said upper ply including frangible means defining said selectively removable means for concealing said groups of game symbols in the form of a plurality of flap-like portions of said upper ply, which said flap-like portions are respectively arranged in registry with said groups of game symbols, and which can be moved out of overlying relationship relative to said lower ply upon fracture of said frangible means by a player.

4. The gaming apparatus in accordance with claim 1, wherein said multiple winner code designations comprise alphabetic designations.

5. The gaming apparatus in accordance with claim 1, wherein said predetermined award values comprise dollar values.

6. The gaming apparatus in accordance with claim 1, wherein each of said playing cards includes five horizontally arranged rows of said groups of game symbols for play of the card.

* * * * *